US009707794B1

(12) United States Patent
McCarthy et al.

(10) Patent No.: US 9,707,794 B1
(45) Date of Patent: Jul. 18, 2017

(54) ADJUSTABLE BOOKMARK INCLUDING A BUCKLE

(71) Applicants: Joanne Lynne McCarthy, Ramona, CA (US); Amanda Lynne McCarthy Campos, Ramona, CA (US); Jennifer Lee Phelan, Ramona, CA (US)

(72) Inventors: Joanne Lynne McCarthy, Ramona, CA (US); Amanda Lynne McCarthy Campos, Ramona, CA (US); Jennifer Lee Phelan, Ramona, CA (US)

( * ) Notice: Subject to any disclaimer, the term of this patent is extended or adjusted under 35 U.S.C. 154(b) by 19 days.

(21) Appl. No.: 14/730,657

(22) Filed: Jun. 4, 2015

Related U.S. Application Data

(60) Provisional application No. 62/009,216, filed on Jun. 7, 2014.

(51) Int. Cl.
*B42D 9/00* (2006.01)

(52) U.S. Cl.
CPC ..... *B42D 9/004* (2013.01)

(58) Field of Classification Search
CPC ..... B42D 9/004; B42D 3/145
See application file for complete search history.

(56) References Cited

U.S. PATENT DOCUMENTS

| | | | | | |
|---|---|---|---|---|---|
| 2,645,197 | A * | 7/1953 | Jones | B42D 3/145 | 116/238 |
| 3,020,876 | A * | 2/1962 | Riden | B42D 9/004 | 116/238 |
| 4,041,892 | A * | 8/1977 | Nichols | B42D 3/14 | 116/239 |
| 4,505,219 | A * | 3/1985 | Mangano | B42D 3/14 | 116/234 |
| 7,004,106 | B1 * | 2/2006 | Forance | B42D 9/004 | 116/234 |
| 7,562,636 | B2 * | 7/2009 | Regala | B43K 23/001 | 116/234 |
| 2007/0029780 | A1 * | 2/2007 | Harris | B42D 9/004 | 281/42 |

* cited by examiner

*Primary Examiner* — Sarah McPartlin

(57) ABSTRACT

An adjustable strap, comprised of four straps, which fastens on the spine of the book using a fitting mechanism. The second strap, comprised of three straps, is comprised of one strap made of elastic material that is inserted in the middle of the book pages. The second strap is fastened to the second end of the first strap and the first end of the third strap which wrap around the spine of the book and fastens through the fitting mechanism, making the strap as a whole, adjustable to fit different sized books. The fourth strap, acting as the bookmark(s), is attached to the first strap so it/they can be inserted between a single page or multiple pages to mark a place in a book. The bookmark is adjustable to fit different sized books and stays securely attached until removed and placed on another book.

7 Claims, 3 Drawing Sheets

ADJUSTABLE BOOKMARK INCLUDING A BUCKLE

CROSS-REFERENCE TO RELATED APPLICATIONS

62/009,216

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of books.

More particularly, the present invention is in the technical field of bookmarks to mark a single place or multiple places within a book.

Bookmarks are known devices to mark a place within a book. Previous bookmarks can become dislodged from the book, causing one to lose their place, or require multiple loops on both covers to secure the device, or don't offer a means to adjust and secure two ends making the bookmark adjustable to fit any size book, or they don't offer the flexibility of being readily placed on another book. For example, as illustrated in U.S. Pat. Nos. 2,645,197 and 3,059,609, the bookmark is attached to the binding of the book and cannot be readily moved to fit another book. As illustrated in U.S. Pat. No. 8,127,708, the bookmark must be secured by two loops that do not attach to a top or bottom end. As illustrated in U.S. Pat. No. 8,307,777, the bookmark clips to one end allowing it to become dislodge from the book.

BRIEF SUMMARY OF THE INVENTION

The present invention is an adjustable bookmark that easily and securely attaches to the spine of the book through the middle pages using a fitting mechanism. The bookmark can be used on hardcover and softcover books with the ability to mark a single place or multiple places within a book. The fitting mechanism prevents the bookmark from becoming dislodged or lost from the book but can readily be taken on, taken off, adjusted to fit the book height and reused on your next book.

DETAILED DESCRIPTION AND BEST MODE OF IMPLEMENTATION

Figure 1:
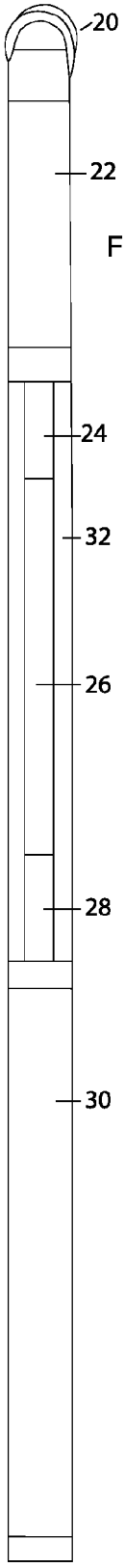
FIG. 1 is a perspective view of the back facing side of the present invention.

Referring now to the invention in more detail, FIG. 1 shows a perspective view of the back of the bookmark. The first strip 22 of the bookmark has a first end and a second end, and is constructed of ribbon or any other sufficient unyielding material that folds through two D-rings 20 or any other sufficient fitting mechanism such as a buckle, slides, belt clip, O-rings or the like. Stitching below the D-rings 20 holds the fitting mechanism in place. The first strip 22 of the bookmark is attached to a second strip 24, 26, and 28 which is comprised of three sections. The first and third section of the second strip 24 and 28 is constructed of ribbon or any other sufficient unyielding material and can be, but not limited to, 1/16, 1/8, or 1/4 in width. The second section 26 is constructed of elastic material and can be, but not limited to, 1/16, 1/8, or 1/4 in width. The second strip of the bookmark 24, 26, and 28 are constructed using the same width material. The first and third section of the second strip 24 and 28 are secured to the second section 26 with adhesive and stitching. The second end of the first strip 22 of the bookmark is attached to the first section of the second strip 24 of the bookmark with adhesive and stitching. The third strip 30 of the bookmark has a first end and a second end and is attached to the third section of the second strip 28 with adhesive and stitching. The third strip 30 of the bookmark is constructed of ribbon or any other sufficient unyielding material.

In more detail, still referring to the invention on FIG. 1 the piece of the bookmark used to mark a place in a book is the fourth strip 32 and is secured to the front second end of the first strip 22 of the bookmark with adhesive and stitching. The first and third section of the second strip 24 and 28 of the bookmark is secured between the folded material of the second end of the first strip 22 and the folded material of the first end of the third strip 30 of the bookmark. Stitching and adhesive hold it in place.

In further detail, still referring to the invention of FIG. 1 the first strip 22 of the bookmark, the third strip 30 of the bookmark, and the fourth strip 32 of the bookmark used to mark a place in a book, can be constructed of ribbon or any other sufficient unyielding material in various widths such as 3/8, 1/2, 5/8, 3/4, 1 inch and the like. The first strip 22 of the bookmark and the third strip 30 of the bookmark are constructed using the same width material. The fourth strip 32 of the bookmark used to mark a place in a book can be constructed using the same width of the first strip 22 and the third strip 30 of the bookmark but can also vary in width. The first strip 22 of the bookmark and the third strip 30 of the bookmark are constructed of a single piece of material folded in half lengthwise.

In further detail, still referring to the invention of FIG. 1 the second strip 24, 26, and 28 of the bookmark, comprised of three sections, are stretched vertically between two pages in the middle of the book. The second section of the second strip 26 enables the second strip 24, 26, and 28 of the bookmark, comprised of three sections, to adjust to the height of the book. The first strip 22 of the bookmark folds down the top spine of the book. The third strip 30 of the bookmark folds up the bottom spine of the book. The third strip 30 of the bookmark can then be looped through the D-rings 20 or any other fitting mechanism such as a buckle, slides, belt clip, O-rings or the like, to secure the first strip 22 of the bookmark to the second end of the third strip 30 of the bookmark. The fourth strip 32 of the bookmark, used to mark a place in a book, can then be suspend through a page of the book and closed to mark a place.

In further detail, still referring to the invention of FIG. 1, the first strip 22 of the bookmark remains the same length and the third strip 30 of the bookmark is longer so it can be looped through the D-rings 22 or any other fitting mechanism such as a buckle, slides, belt clip, O-rings or the like, to secure the first strip 22 of the bookmark to the third strip 30 of the bookmark and adjust to the books height.

Figure 2:
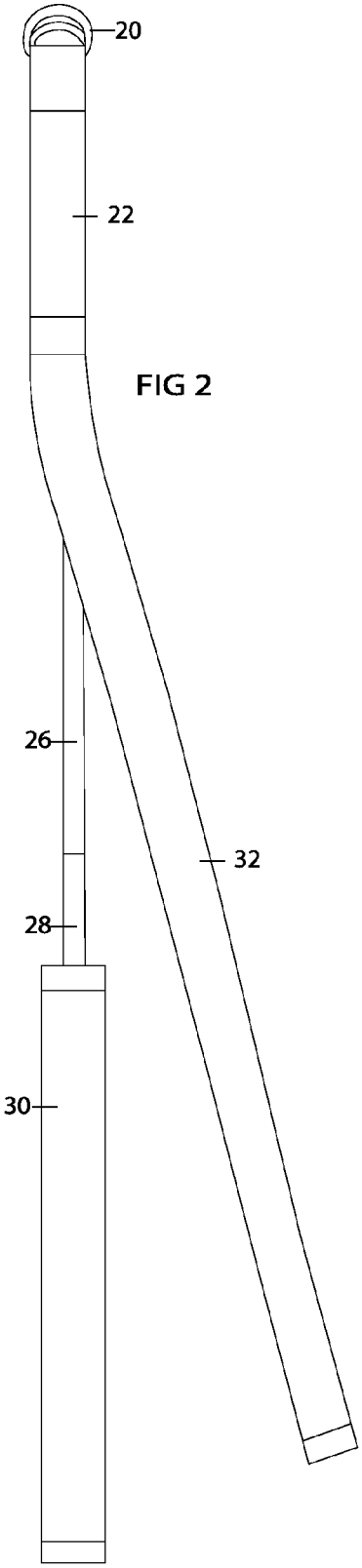
FIG. 2 is a perspective view of the front facing side of the present invention.

Referring now to the invention in more detail, FIG. 2 shows a perspective view of the front side of the bookmark. The first strip 22 of the bookmark is folded lengthwise to form a loop at the first end to secure the D-rings 20 or any other fitting mechanism such as a buckle, slides, belt clip, O-rings or the like.

Figure 3:
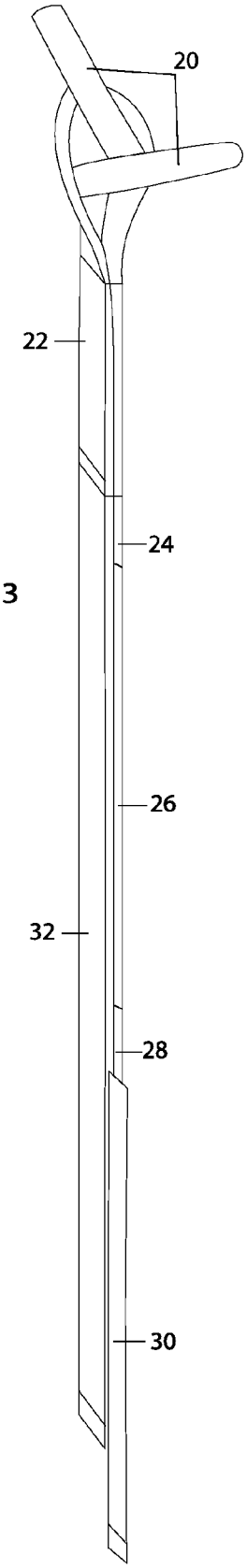
FIG. 3 is a perspective view of the side of the present invention.

Referring now to the invention in more detail, FIG. 3 shows a side view of the bookmark. The first strip 22 of the bookmark is folded lengthwise to form a loop at the end that secures the D-rings 20 or any other fitting mechanism such as a buckle, slides, belt clip, O-rings or the like. The fourth strip 32 of the bookmark used to mark a place in a book is secured to the top of the second end of the first strip 22 of the bookmark with adhesive and stitching. Under the fourth strip 32 of the bookmark used to mark a place in a book is the second strip 24, 26, and 28 of the bookmark, comprised of three sections, and the third strip 30 of the bookmark.

Referring now to the invention in more detail, FIG. 3 shows a side view of the bookmark. The first strip 22 of the bookmark is constructed of a piece of material folded in half lengthwise. D-rings 20 or any other fitting mechanism such as a buckle, slides, belt clip, O-rings or the like are secured within the fold of the first strip 22 of the bookmark. The fourth strip 32 of the bookmark used to mark a place in a book is secured to the front second end of the first strip 22 of the bookmark. The second strip 24, 26, and 28 of the bookmark, comprised of three sections, is secured in-between the fold of the second end of the first strip 22 of the bookmark by the first section of the second strip 24. The third section of the second strip 28 is secured in-between the fold at the first end of the third strip 30 of the bookmark.

Figure 4:
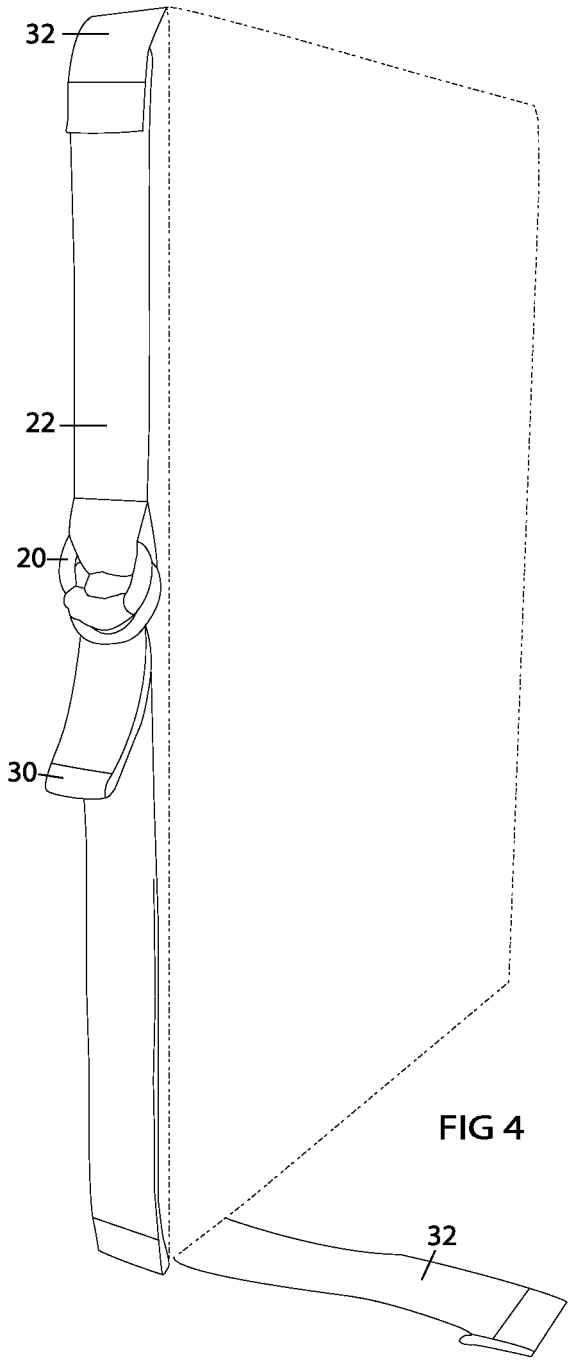
FIG. 4 is a perspective view of the present invention assembled on a book.

Referring now to the invention in more detail, FIG. 4 illustrates the bookmark in use on a book. The first strip 22 of the bookmark folds down the back of the book spine and secures to the third strip 30 of the bookmark by folding through the D-rings 20 or any other fitting mechanism such as a buckle, slides, belt clip, O-rings or the like. The fourth strip 32 used to mark your place in a book folds down in-between the pages of the book and suspends out the bottom of the book to mark a place.

Figure 5:
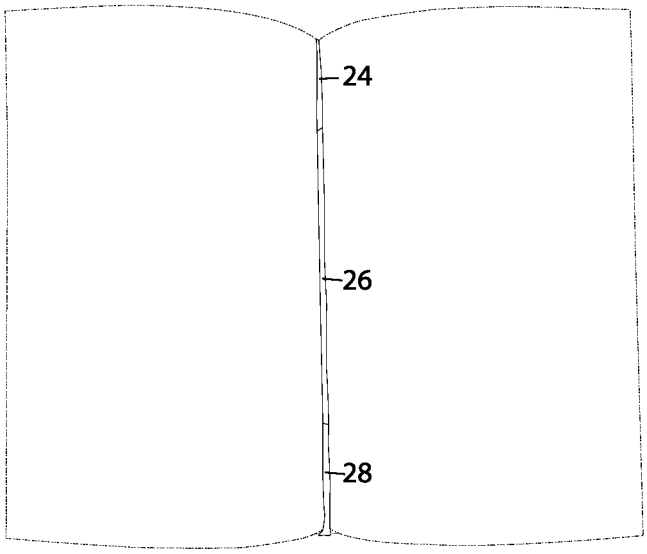
FIG. 5 is a perspective view of the present invention assembled through the middle pages of a book.

Referring now to the invention in more detail, FIG. 5 illustrates the second strip 24, 26, and 28 of the bookmark, comprised of three sections, stretched vertically within the middle of the book pages so one can attach the first strip 22 of the bookmark to the third strip 30 of the bookmark along the spine of the book. The first strip 22 of the bookmark and the third strip 30 of the bookmark can be embellished with embroidery, charms, medallions, rhinestones, and the like.

Figure 6:
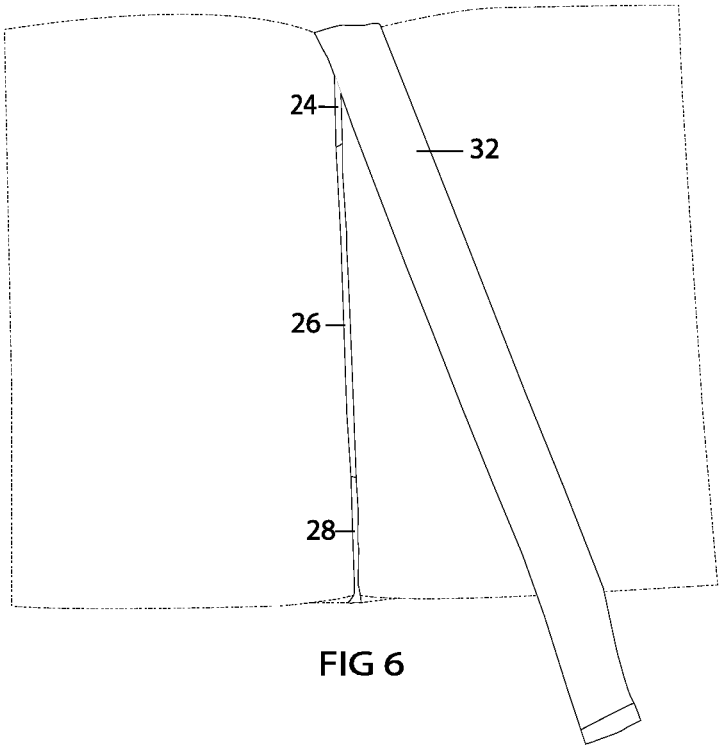
FIG. 6 is a perspective view of the present invention and how one marks their place in a book.

Referring now to the invention in more detail, FIG. 6 illustrates the fourth strip 32 of the bookmark used to mark your place in a book being suspended between two pages to mark a place. In some embodiments, there can be more than one fourth strip 32 used to mark a place in a book. This gives the user the option of marking multiple places within one book. The fourth strip 32 of the bookmark used to mark a place in a book can be embellished with embroidery, charms, medallions, pendant, rhinestones, beads, and the like. A ribbon clamp can be secured to the second end of the fourth strip 32 of the bookmark used to mark a place so a charm, medallion, pendant, beads or the like can be attached. In some embodiments, the first strip 22 of the bookmark and the third strip 30 of the bookmark can be embellished with embroidery, charms, medallions, pendant, rhinestones, beads, and the like.

While this written description of the invention enables one to make and use what is considered presently to be the best mode thereof, they will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

The invention claimed is:

1. A bookmarking device comprising:

a first strip having a first end and a second end;

a fitting mechanism attached to the first end of the first strip;

a second strip comprised of three sections of which one end is attached to the second end of the first strip;

a first section and a third section of the second strip comprising unyielding material;

a second section of the second strip positioned between the first and third sections of the second strip, the second section of the second strip comprising an elastic material;

a third strip having a first and second end of which the first end is attached to the other end of the second strip and is kept open ended at the second end, the third strip is adapted to be removably attached to the fitting mechanism; and a fourth strip having a first end and second end of which the first end is attached to the second end of the first strip and is kept open ended at the second end to mark a place in a book.

2. The bookmarking device of claim 1, wherein the second strip comprises three strips attached together, wherein one of the three strips is made of an elastic material.

3. The bookmarking device of claim 1, wherein the fitting mechanism may be selected from the group consisting of D-rings, buckle, belt clip, slides and O-ring.

4. The bookmarking device of claim 1, wherein the fourth strip comprises multiple strips of material to mark multiple places in a book.

5. The bookmarking device of claim 1, wherein the first, second, third and fourth strips are assembled through at least one of stitching and adhesive.

6. The bookmarking device of claim 2, wherein the strip made of the elastic material is adapted to be inserted between two pages of a book.

7. The bookmarking device of claim 3, wherein the second end of the third strip is adapted to be removably attached and adjusted through the fitting mechanism.

* * * * *